US006374797B1

(12) United States Patent
Fischer

(10) Patent No.: US 6,374,797 B1
(45) Date of Patent: Apr. 23, 2002

(54) OIL CIRCUIT FOR AN ENGINE

(75) Inventor: Jochem Fischer, Marbach (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/679,522

(22) Filed: Oct. 6, 2000

(30) Foreign Application Priority Data

Oct. 8, 1999 (DE) ..... 198 48 658

(51) Int. Cl.[7] ..... F01M 1/00
(52) U.S. Cl. ..... 123/196 R; 184/1.5
(58) Field of Search ..... 123/196 R, 198 E; 210/172; 184/1.5

(56) References Cited

U.S. PATENT DOCUMENTS 5,130,014 A * 7/1992 Volz ..... 184/1.5
5,640,936 A * 6/1997 Hudson ..... 184/1.5
5,642,702 A * 7/1997 Kouchi et al. ..... 123/198 E

FOREIGN PATENT DOCUMENTS

DE 196 44 645 4/1998
DE 198 33 974 2/1999

* cited by examiner

*Primary Examiner*—Noah P. Kamen
(74) *Attorney, Agent, or Firm*—Crowell & Moring LLP

(57) ABSTRACT

A module (13*a*) for the lubricating oil circuit of an internal combustion engine or some other type of working machine is proposed, which comprises at least an oil supply (14) that can be exchanged or replaced together with the unit (13*a*). Valves (24) prevent oil from flowing out of the unit during the exchange. This enables a reliable oil change to be achieved. The module can be equipped with additional functional elements such as a filter element (23), an oil pump (26), a supplemental centrifuge (29), an additive reservoir (31) and/or various sensors (S1, S2).

8 Claims, 1 Drawing Sheet

OIL CIRCUIT FOR AN ENGINE

BACKGROUND OF THE INVENTION

The invention relates to an oil circuit for a working machine, especially an internal combustion engine.

Such oil circuits in the state of the art are at least partially integrated into the engine block of an internal combustion engine. Especially the oil pan which forms a reservoir for the lubricant oil is provided in the bottom part of the engine block. It is directly connected with the crankcase, and the lubricant oil collects in it so as to be returned by means of a pump back to the lubrication points of the internal combustion engine.

An effort is being made to keep the manufacturing cost involved in the oil circuit as low as possible. This can be achieved by integrating the components necessary for the oil circuit into the motor block. For example, it is proposed in DE 198 33 974 A1 (=GB 2,327,625) to design the oil filter as a flat filter and insert it into a receiver provided for it in the oil pan. Another possibility is to integrate the pump of the oil reservoir into the oil pan, as proposed in DE 196 44 645 A1 (=EP 838,577).

These measures are capable of reducing the design cost of the internal combustion engine and thus reducing the manufacturing and assembling costs. However, the operating costs cannot be reduced by that. All that can be done is to strive for long maintenance intervals through the quality of the oil and by extending the useful life of the filter. The maintenance itself presents difficulties; the used filter elements have to be removed and the old oil drained out. There is danger of contaminating the environment with accidentally lost oil. Also, the used-up filter elements as well as the old oil must be disposed of properly.

SUMMARY OF THE INVENTION

It is therefore an object of the invention to provide an oil circuit which in addition to low manufacturing and installation costs will entail low cost of operation.

It is also an object of the invention to provide an oil circuit which will permit easy as well as reliable maintenance.

These and other objects are achieved in accordance with the invention by providing an oil circuit for a working machine comprising an oil reservoir and a conduit system for delivering oil to lubrication points of the machine, wherein the reservoir is integrated into an insert unit which is replaceably disposed in a receptacle and which forms a part of the oil circuit.

The oil circuit according to the invention is comprised of a circulatory system to deliver oil to the lubrication points of the machine and a reservoir for the oil from which the circulatory system is supplied. Also, any oil that is not needed for circulation flows into this reservoir. The oil circuit according to the invention is characterized in that this reservoir is part of an insert unit which is placed in a receptacle in the working machine. The insert unit thus forms part of the oil circuit and can easily be replaced with a new one in order to change the lubricant oil. Receptacles for such insert units can be provided, for example, on the engine which contains the oil circuit. The exchange can then be simply performed by releasing the fastening of the insert unit that is connected to the receptacle.

The insert unit can be attached to the engine or the oil circuit, the receptacle being comprised of, for example, a bayonet connector, or according to another embodiment of the invention an installation opening can be provided which can be opened to install the insert unit and then closed. Alternatively, a drawer-like receptacle can be provided for receiving the insert unit; for example, a receptacle which facilitates handling when the insert unit is exchanged. The cover of the installation opening furthermore leads to greater reliability of the oil circuit in operation because an additional seal can be produced by the cover.

In one practical embodiment of the invention, the insert unit and the conduit system of the oil circuit have connectors which can be joined together when the insert unit is installed. This can be performed by a separate attachment of the conduit system (tubing, for example), or the connectors may be integrated into the insert unit such that the insert unit is automatically connected to the circulation system by its insertion into the receptacle. As an alternative to the connectors, the insert unit can also be constructed with an open structure, so that the connectors of the conduit system can extend into it. The insert unit itself then has no connectors.

An especially reliable variant of the invention as regards maintenance is obtained when the connectors have valves which close if the insert unit becomes separated from the oil circuit. This can be accomplished manually or automatically through a corresponding linking of the valves to the connectors. Advantageously, when the insert unit is separated from the oil circuit, all openings through which the oil could pass into the environment become closed. Replacement of the insert unit is thereby especially secure and can be performed even by untrained personnel.

The removed insert unit is by itself a sealed system and can be discarded as a whole to dispose of the old oil. In a special application of the invention the insert unit is taken back with the old oil by the oil producer, who replaces the old oil with fresh oil and then can resell the refurbished insert unit again. This kind of embodiment permits recycling the old oil and multiple use of the insert units, similar to the principle of the returnable bottle.

In one preferred embodiment of the invention, the insert unit can be housed in the cylinder head of an internal combustion engine. In general, this area of the motor block is quite easily accessible so that the insert unit can be easily replaced. Since the insert unit is simultaneously the container for the lubricating oil and the cylinder head is generally located in the top part of the internal combustion engine, the oil must be pumped into the insert unit by the oil circulation pump provided for the lubricating oil circuit. For this purpose a lubricant oil collection point can be provided in the lowest part of the lubricating oil circuit, from where the oil circulation pump pumps the lubricating oil into the insert unit. The pump can be controlled by an appropriate sensor.

Alternatively, the insert unit can be housed at the lowest point in the oil circuit. In this case it replaces the oil pan which has been provided in the prior art for the collection of the oil. If the internal combustion engine is not used, the oil then collects in the insert unit. This has the advantage that, when the insert unit is replaced, most of the old oil can be replaced. In this mode of the invention, all contaminants of the lubricant oil which normally would collect on the bottom of the oil pan remain in the insert unit, and therefore they too are removed. The new insert unit is entirely free of contaminants.

Practical embodiments of the invention are obtained when additional functional elements of the oil circuit are integrated into the insert unit. Examples of such functional elements include the pumps for circulating the lubricant oil and for producing pressure at the lubrication points, as well as an oil deterioration sensor to indicate the need for insert unit replacement, a filter element for cleaning the oil, and/or an oil centrifuge which also can serve for cleaning the oil. Moreover, sensors for the loading of the centrifuge or for wear on the filter medium may be appropriate. The useful lives of the individual functional elements can be coordinated with one another, so that all functional elements will be used up when the filter insert must be replaced. This is especially true for the filter element and the lubricant oil. Of course, functional elements such as the centrifuge and the pump can be matched to the life of the insert unit. They are then supplied together with the filter element and the oil deterioration sensor.

Another possibility, which of course can make sense in the case of the return and refilling of the insert units by the manufacturer, is to design the pump or also the centrifuge for several life cycles of the filter inserts and lubricant oil. These components thus become more expensive, but can be used for a longer time. In particular, the inclusion of the pump or centrifuge creates the possibility of cleaning them when the oil is changed, so that their useful life is longer.

Another possibility is to include a container for oil additives which can be dispensed continuously or at periodic intervals during the life cycle of the oil. These can extend the life of the oil considerably and maintain the required properties of the oil.

In another embodiment of the invention, the insert unit can have additional connections. Thus it is possible on the one hand to achieve a greater branching out of the oil circuit by fastening more connectors to the insert unit, and on the other hand, different kinds of connectors may be necessary for components built into the insert unit; for example, an electrical connection may be provided for the operation of an electric circulation pump integrated into the insert unit.

It is advantageous to provide different identifying marks on insert units of different models, thus avoiding the danger that wrong insert units will be accidentally installed. This is necessary especially when the sizes of the insert unit connectors are the same but oils of different quality are used. For example, insert units for diesel engines might be distinguished from insert units for Otto cycle engines.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
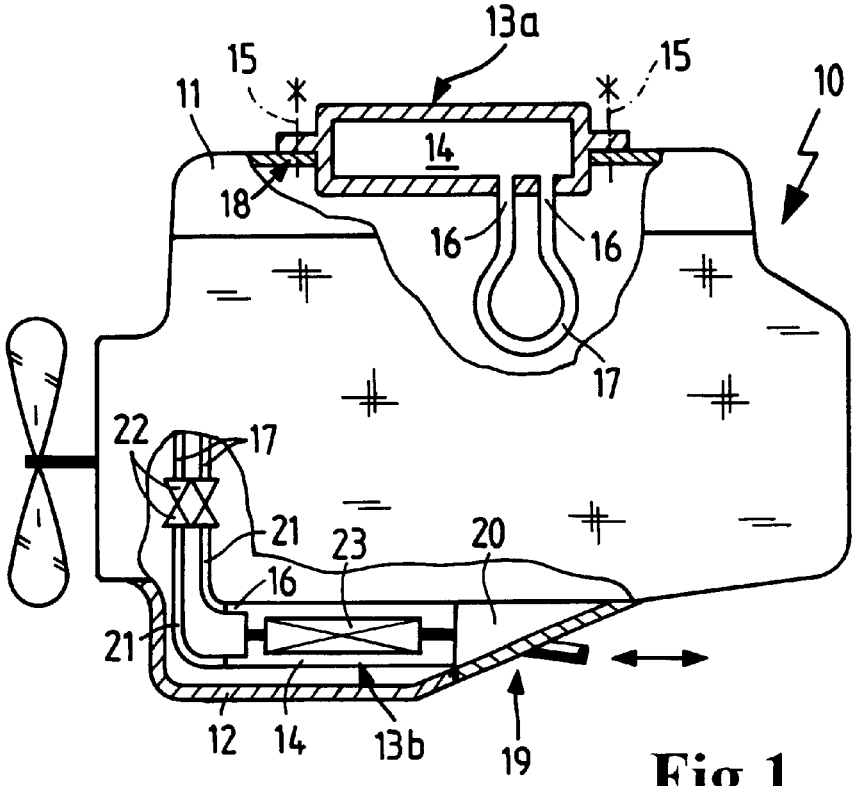
FIG. 1 is a schematic illustration of an internal combustion engine with various possible locations for installing the insert unit according to the invention.

An internal combustion engine 10 according to FIG. 1 is shown in outline. In particular, a cylinder head cover 11 and an oil pan 12 can be recognized as separate areas of the internal combustion engine. Insert units 13*a* and 13*b* constitute a reservoir 14 for lubricant oil for the internal combustion engine. The insert unit 13*a* is held by fasteners 15 on the cylinder head cover 11. The insert unit has connections 16 for an indicated lubricating oil circuit consisting of a system of tubing 17.

The cylinder head cover 11 forms a receptacle 18 for the insert unit 13*a*. Alternatively, an installation opening 19 can be provided, which here especially is closed by a drawer 20, the drawer containing the insert unit 13*b* in the oil pan 12 of the internal combustion engine. The connections 16 are automatically joined to connections 21 in the internal combustion engine. The connections 21 belong to the tubing system 17 of the internal combustion engine and are closed by valves 22 when the insert unit 13 is removed. A filter element 23 is arranged in the insert unit 13*b*. It is preferably a flat filter element, but a round filter cartridge can also be installed.

Figure 2:
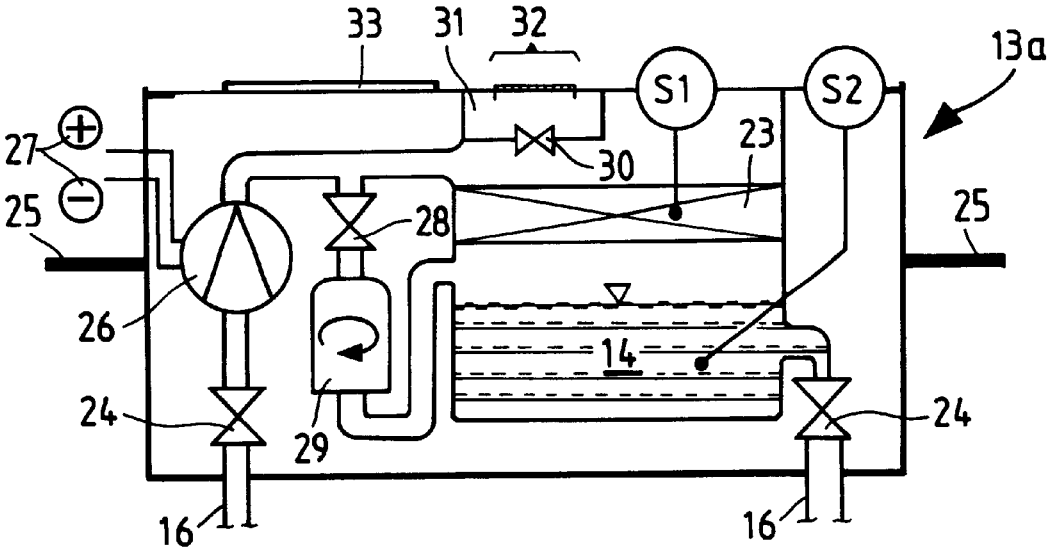
FIG. 2 is a schematic diagram of an insert unit according to the invention.

The schematic construction of an insert unit is illustrated in FIG. 2. The two connections 16 serve for the delivery and removal of the oil in the lubricating oil circuit, which is not shown. Here valves 24 are arranged, which prevent oil loss when the insert unit is removed. The insert unit has a mounting flange 25 which permits the insert unit to be attached, for example, to the cylinder head of an internal combustion engine.

The heart of the insert unit is the lubricant oil reservoir 14. Of course, additional functional elements can be integrated into the insert unit.

One of these is a pump 26 which is provided with electrical terminals 27. Also, a filter element 23 is provided through which the lubricant oil must pass after flowing through the lubricant oil circuit which is not shown. In a bypass through an additional valve 28 there is a free-jet centrifuge 29 by means of which a portion of the lubricating oil can be freed of very small particles. Moreover, a reservoir 31 provided with a feed valve 30 is provided for lubricant additives.

Externally on the insert unit various sensors are provided. It is conceivable, for example, to provide a wear and tear sensor S1 for the filter element, as well as a dirt sensor S2 for the lubricant oil. Also, an inspection glass 32 can be provided to indicate the level of oil in the reservoir 31. In addition, an identification plate 33 is applied to the exterior of the insert unit.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. An oil circuit for a working machine comprising an oil reservoir and a conduit for delivering oil to lubrication points of the machine, wherein the reservoir is integrated into an insert unit which is replaceably disposed in a receptacle in the machine and which forms a part of the oil circuit;

wherein said working machine is an internal combustion engine; and wherein the insert unit is accommodated in a cylinder head of the internal combustion engine.

2. An oil circuit according to claim 1, wherein an installation opening is provided for the insert unit and can be closed after installation of the insert unit.

3. An oil circuit according to claim 1, wherein the insert unit and the conduit system are provided with oil connections which are connected to one another when the insert unit is installed in said receptacle.

4. An oil circuit according to claim 3, wherein the insert unit connections are provided with valves which close when the insert unit is removed from the oil circuit and thereby prevent loss of oil from the insert unit.

5. An oil circuit according to claim 1, wherein the insert unit forms the lowest point of the oil circuit.

6. An oil circuit according to claim 1, wherein at least one additional functional element selected from the group consisting of an oil filter, an oil pump, a centrifuge, and an additive reservoir, is integrated into the insert unit.

7. An oil circuit according to claim 6, wherein the insert unit and the receptacle are provided with oil connections for said at least one additional functional element which are connected to each other when the insert unit is installed in the receptacle.

8. An oil circuit according to claim 1, further comprising an identifying mark on said insert unit which identifies the machine or machines which the insert unit fits and with which the insert unit can be used.

* * * * *